US006197409B1

(12) United States Patent
Bodager et al.

(10) Patent No.: US 6,197,409 B1
(45) Date of Patent: Mar. 6, 2001

(54) INK-JET MEDIA

(75) Inventors: Gregory A. Bodager, Madison, OH (US); Jon Gregory Moehlmann, Sayre; Daphne Pinto Fickes, Kennet Square, both of PA (US); Robert Paul Held, Newark, DE (US); Ray Alexander Work, III, Kennett Square, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 08/870,992

(22) Filed: Jun. 6, 1997

Related U.S. Application Data

(63) Continuation of application No. 08/568,850, filed on Dec. 7, 1995, now abandoned.

(51) Int. Cl.[7] ..... B41M 5/00; B41M 5/26

(52) U.S. Cl. ..... 428/212; 428/195; 428/914; 156/235

(58) Field of Search ..... 425/195, 200, 425/203, 207, 500, 520, 522, 215, 914; 156/235

(56) References Cited

U.S. PATENT DOCUMENTS

| | | | | |
|---|---|---|---|---|
| 4,785,313 | * | 11/1988 | Higuma et al. | 346/135.1 |
| 4,904,519 | | 2/1990 | Newman | 428/203 |
| 4,935,307 | | 6/1990 | Iqbal et al. | 428/500 |
| 4,956,230 | | 9/1990 | Edwards et al. | 428/341 |
| 4,983,487 | | 1/1991 | Gilreath | 430/126 |
| 5,134,198 | | 7/1992 | Stofko, Jr. et al. | 525/205 |
| 5,192,617 | | 3/1993 | Stofko, Jr. et al. | 428/411.1 |
| 5,208,092 | | 5/1993 | Iqbal | 428/195 |
| 5,219,928 | | 6/1993 | Stofko, Jr. et al. | 525/57 |
| 5,241,006 | | 8/1993 | Iqbal et al. | 525/196 |
| 5,302,436 | | 4/1994 | Miller | 428/195 |
| 5,352,736 | | 10/1994 | Stofko, Jr. et al. | 525/57 |
| 5,501,902 | * | 3/1996 | Kronzer | 428/195 |
| 5,560,982 | * | 10/1996 | Sato | 428/195 |
| 5,662,997 | * | 9/1997 | Onishi et al. | 428/518 |

FOREIGN PATENT DOCUMENTS

| | | | |
|---|---|---|---|
| 0 285 145 A2 | 10/1988 | (EP) | B41M/1/30 |
| 0 539 946 A1 | 5/1993 | (EP) | B41M/5/00 |
| 0 538 168 A2 | 2/1994 | (EP) | B41M/5/38 |
| 0 608 763 A1 | 8/1994 | (EP) | B41M/5/00 |
| 0 663 300 A1 | 7/1995 | (EP) | B41M/5/00 |
| 0 671 282 A2 | 9/1995 | (EP) | B41M/5/00 |
| 0 688 677 A1 | 12/1995 | (EP) | B41M/5/00 |
| 0 696 516 A1 | 2/1996 | (EP) | B41M/5/00 |
| 910700 | 11/1962 | (GB) . | |
| 6-32065 | 2/1994 | (JP) | B41M/5/30 |
| 6-286325 | 10/1994 | (JP) | B41M/5/26 |
| 93/01938 | 2/1993 | (WO) | B41M/5/00 |

* cited by examiner

*Primary Examiner*—Pamela R. Schwartz

(57) ABSTRACT

Media are disclosed having a substrate, water-absorbing layer, and adhesive ink-receiving layer. After being printed with an aqueous pigmented ink, the ink-receiving layer may be laminated to a permanent substrate. Exposure to an energy source may render the printed image more durable.

18 Claims, No Drawings

INK-JET MEDIA

This is a continuation of application Ser. No. 08/568,850 filed Dec. 7, 1995, now abandoned.

FIELD OF THE INVENTION

This invention relates to media used in ink-jet printing, and more particularly to media that provide a durable, water-fast image.

BACKGROUND OF THE INVENTION

Ink-jet printing is a non-impact method for recording information in response to an electronic signal, such as that generated by a computer. In the printer, the electronic signal produces droplets of ink that are deposited on media, such as paper or transparent film. Ink-jet printers have found broad commercial acceptance due to their reliability, relatively quiet operation, graphic capability, print quality, and low cost.

In current ink-jet printing applications, several inks (typically black, cyan, magenta and yellow) are used to print textual and graphic information on a printing medium, typically ordinary paper. The inks primarily are composed of water, and contain a colorant that may be a dye or pigment dispersion. Pigment dispersions are preferred since the dyes are highly soluble and tend to smear upon handling. Pigment dispersions offer improved water and smear resistance, as well as better light stability. The inks generally also contain a polyhydric alcohol to prevent nozzle clogging, and may contain various adjuvants. Such inks and ordinary paper are well suited for desk-top publishing, as currently practiced, wherein only a small portion of the paper receives printed text and graphic information.

It also is desired to reproduce high quality colored pictoral information (such as photographs and the like) using ink-jet technologies for applications such as commercial printing and desk-top publishing. In these applications, however, the printing medium will receive substantially more of the black and colored inks in order to accurately reproduce the various hues, tints, and colors contained in a typical colored picture. For example, the printing medium will be expected to receive up to 200% or more coverage in conventional commercial printing applications.

Ordinary paperstock is not suitable for such high quality applications for a number of reasons. Water disrupts the paper structure, causing "cockle" that affects appearance of the paper and, in extreme cases, may actually cause the paper to distort to the extent that it contacts the ink-jet pen, disrupting the printing process. Also, the paper may not absorb water sufficiently quickly to achieve the desired printing speed, or may cause flooding of the paper surface, which adversely affects image quality. Moreover, wicking of ink into the paper may cause the paper to "show through" into the printed image, detracting from image quality. There also is a need for the printed text and pictures to be more robust; e.g., exhibit better handleability, water fastness, and smear resistance after printing.

Special ink-jet media currently employ vehicle absorbtive components, and optionally additives, to bind the dyes to the media. The purpose is to provide reduced bleed, whereby the intrusion of one color into an adjacent color is minimized. As a consequence current media are inherently moisture sensitive, can be quite fragile to handling, and are subject to finger smearing. Moreover, the vehicle absorptive components usually consist of water-soluble polymers which results in slower printing speeds. In addition the water absorptive components leave the paper quite sensitive to moisture and smearing.

Thus, a need exists for media that will provide a printed image having improved durability, water-fastness, and smear resistance in both imaged and non-imaged areas. A specific need exists for such media capable of reproducing colored pictoral information in high quality, thereby meeting the demanding requirements of commercial printing.

SUMMARY OF THE INVENTION

The present invention provides a media particularly adapted to receive printed images involving large quantities of an aqueous ink-jet ink containing a pigment colorant. The printed image is readily transferred to a permanent substrate, which may be paper, due to an adhesive component contained in the ink-receiving layer of the media.

Accordingly, in one embodiment, the invention provides a media particularly adapted to receive a pigmented ink image from an ink-jet printer for subsequent transfer to a permanent substrate. The media has, in order:

(a) a substrate;

(b) a water-absorbing layer comprising a hydrophilic polymer that is substantially solid in the presence of aqueous pigmented ink; and (c) a transparent, adhesive, ink-receiving layer that retains the aqueous ink pigment and is permeable to the aqueous ink medium.

In preferred embodiments, the ink-receiving layer may contain a thermoplastic polymer that is subsequently cross-linked, conveniently by lamination, as the ink-receiving layer is transferred to a permanent substrate. This cross-linking improves durability of the printed image. The ink-receiving layer also may contain a Reactive Component that aids binding of the ink colorant to the ink-receiving layer.

In other embodiments, the invention provides a process for using the media to create a printed image on the media, and transfer the printed image to a permanent substrate. The media and process provide special utility in demanding ink-jet printing applications involving printing of pictoral information, which requires more ink than normally used in printing text.

DETAILED DESCRIPTION OF THE INVENTION

The present invention provides an ink-jet transfer media that provides printed images having improved durability, water-fastness and smear resistance, on both imaged and non-imaged areas of the media.

The media is adapted to receive the relatively large volumes of ink needed to generate high quality pictoral information, and has a substrate, a water-absorbing layer, and an ink-receiving layer.

MEDIA SUBSTRATE

The media substrate (i.e., "support") is a material having sufficient stiffness and dimensional stability to support a printed image without having the image distort or misalign, and sufficient water resistance that it can be exposed to an aqueous ink without warping or shrinkage. The material also must withstand heat and pressure applied during the lamination steps described below. The support typically has a thickness of about 25 to about 250 micrometers (1.0 to 10 mils), preferably about 50 to 200 micrometers (2 to 8 mils). Suitable materials include polymeric films, such as polyethylene terephthalate and polyethylene naphthanate, polyamides, polycarbonates, fluoropolymers, polyacetals, and polyolefins. Thin metal sheets may be selected, as well as natural or synthetic paper treated to be water resistant. The substrate may be transparent, translucent, or opaque. It may be colored and can have components, such as antihalation dyes, incorporated therein to meet the needs of specific applications. Polyethylene terephthalate films are a preferred support material.

Conventional antistat coatings may be present on one or both sides of the support to reduce static if the support is later separated from its coating layer by "peeling", as discussed below. The substrate also may have a release layer or surface if it is desired to peel the substrate off after transfer. Materials having a release surface, such as polyethylene or a fluoropolymer, may be selected. Alternatively, a thin release layer may be used to promote separation of the media layers. Useful release layers are well known in the art and include, for example, silicones, melamine acrylic resins, vinyl chloride polymers and copolymers, vinyl acetate polymers and copolymers, plasticized polyvinyl alcohols, ethylene and propylene polymers and copolymers, etc. When a separate release layer is coated onto the support, the layer generally has a thickness in the range of 0.5 to 10 micrometers. The release layer may also contain materials such as antistats, colorants, antihalation dyes, optical brighteners, surfactants, plasticizers, coating aids, matting agents, and the like.

An anchor layer may be used to ensure adequate adhesion of the release layer (if used) to the support. The term "anchor layer", as employed in the art, means a layer that is adhesively bonded to the layers on both sides of it. Adhesive materials for bonding different types of materials are well known in the art and are discussed in *Handbook of Adhesives, 2nd Edition,* Irving Skeist, Ed. (Van Nostrand Reinhold Co., New York, 1977). Any conventional adhesive material can be used in the anchor layer or layers so long as it is not adversely affected by the printing step. Representative materials include ethylene/vinyl acetate copolymers, vinyl chloride/vinyl acetate copolymers, vinyl chloride/vinylidene chloride copolymers, thermoplastic polyamides, and the like. The choice of adhesive will depend on the compositions of the release layer and the support. The anchor layer or layers may contain materials such as antistats, colorants, antihalation dyes, optical brighteners, surfactants, plasticizers, coating aids, and the like. The anchor layer(s) generally has a thickness in the range of 0.01 to 10 micrometers, preferably 0.05 to 5 micrometers.

MEDIA WATER-ABSORBING LAYER

The water-absorbing layer removes water, and typically other liquid ink components, from the ink after it has been printed on the ink-receiving layer. This layer is primarily composed of a hydrophilic polymer having hydroxyl, carboxyl, or amino groups. The layer will be sufficiently thick to physically remove the desired amount of water, and other liquid components from the ink-receiving layer, and typically will have a thickness of about 3 to about 30 micrometers (0.1 to 1.2 mils), preferably about 8 to 20 micrometers (0.3 to 0.8 mils). Although composed of a hydrophilic polymer, the particular polymer that is selected is substantially solid in the presence of the ink-jet ink.

Representative polymers that may be selected to advantage include polyvinyl alcohol, polyvinyl alcohol copolymers such as poly(vinyl alcohol-co-vinyl acetate) and poly (vinyl alcohol-co-vinyl pyrrolidone), polyvinyl pyrrolidone, polyvinyl pyrrolidone copolymers such as poly(vinyl pyrrolidone-co-vinyl acetate), hydroxypropyl cellulose, sodium alginate, water-soluble phenol formaldehyde resins, carboxylated styrene butadiene polymers, carboxymethyl cellulose, soluble collagen, gelatin, hydrolyzed ethylene vinyl acetate polymers, and polysaccharides such as xanthan gum, gum tragacanth, locust bean gum, carrageenan, guar gum, agar, salts of dimethylaminoethyl methacrylate containing acrylic or methacrylic copolymers, and the like. Super absorbent acrylic or methacrylic polymer, where the acrylic or methacrylic polymer is modified to the salt form of the carboxylates or sulfonates, may be selected to advantage. Preferred are polyvinyl alcohol or a polyvinyl alcohol copolymer, such as poly(vinyl alcohol-co-vinyl acetate) commonly known as partially hydrolyzed poly(vinyl alcohol).

Properties of the water-absorbing layer may be modified by including other non-water-soluble polymers to provide flexibility, fingerprint resistance, cracking resistance, etc. Thus, acrylic resins such as poly(methyl methacrylate/ethylacrylate/acrylic acid), mixed cellulose esters such as cellulose acetate phthalate, and styrene/maleic acid copolymers, may be blended with the hydrophilic polymer for specific applications. These polymer blends may be solvent coated or aqueous coated in their salt form.

Conventional additives listed earlier as additives for the release layer may also be present in the ink absorbing layer.

MEDIA INK-RECEIVING LAYER

The ink-receiving layer is constructed of an adhesive composition having a balance of properties. The layer holds the image formed by pigment contained in the ink, but is sufficiently permeable to the ink carrier medium (i.e., water that optionally contains liquid organic additives) that the carrier quickly passes through the ink-receiving layer to the water-absorbing layer. Rapid transfer of the aqueous carrier is important to achieve desired printing speeds. The ink-receiving layer is releasably affixed to the water-receiving layer in order that it may be readily separated after being imaged and laminated to a permanent substrate. Since the printed image is viewed through the ink-receiving layer, the layer is transparent and preferably has no yellowness that might shift color balance of the printed image.

It is desirable that the ink-receiving layer not be so tacky at ambient temperatures that it presents a handling problem. However, materials should be avoided that are so slippery that the material presents a registration problem during lamination to the permanent substrate. For many applications, it will be desirable to employ an ink-receiving layer that is scratch and abrasion resistant when wet or dry, and is resistant to cracking or embrittlement over time.

The ink-receiving layer typically has a thickness of 0.1 to 10 micrometers, preferably 0.5 to 3 micrometers, and contains at least 20% adhesive having the properties described above, based on total weight of the layer. Preferably the adhesive will constitute at least 80% of the layer, with the layer also containing thermoplastic polymer and/or Reactive Components described below.

Suitable adhesives are well known in the art and can be selected for a specific application in accordance with *Handbook of Adhesives, 2nd Edition,* Irving Skeist, Ed. (Van Nostrand Reinhold Co., New York, 1977), for example. The exact choice will depend on the media surface that contacts the ink-receiving layer (i.e., a release layer or the water-absorbing layer) and the desired permanent support. Examples of suitable adhesives include polyester resins; polyvinyl alcohol homopolymers and copolymers (e.g., with, methyl methacrylate, or vinyl acetate), polyvinyl pyrrolidone, and blends thereof; and copolymers of vinyl acetate with ethylene and/or vinyl chloride.

For many applications, it will be desired that the printed image be robust and withstand handling or exposure to ambient conditions for protracted times, without undue loss of quality. The inclusion of certain thermoplastic polymers, and/or Reactive Components, are useful to improve durability of the ink-receiving layer after it has received the ink and been transferred to its permanent support.

Thermoplastic Polymer

Useful thermoplastic polymers, which may be incorporated in the ink-receiving layer, soften at elevated temperature and will cross-link when held at that or a higher temperature for a sufficient period of time. Such polymers typically have a molecular weight of at least 6000, and preferably at least 10,000. The term "cross-link", as used herein, means that the polymer has a reactive moiety that will form a physical or chemical bond or linkage. Thermoplastic polymers that are useful for this purpose may either have all the needed functional groups incorporated in one polymer, or may be a blend of polymers, each of which has one or more of the functional groups.

Useful single polymers are hydrophilic polymers having at least one carboxylic group and at least one hydroxyl, epoxy, amine, isocyanate, amide, or acrylamide cross-linkable group. A representative single polymer, which has been found to be useful for this purpose, is the interpolymer formed from 40% N-tert-octylacrylamide/34% methyl methacrylate/16% acrylic acid/6% hydroxypropyl methacrylate/4% t-butyl amino ethyl methacrylate having a molecular weight of approximately 50,000.

Alternatively, blends of (A) at least one polymer having one or more carboxylic acid groups, and (B) at least one polymer having one or more hydroxyl, epoxy, amine, isocyanate, amide, or acrylamide cross-linkable groups, may be selected, provided that the polymers are compatible. By "compatible" it is meant that the resulting blend is capable of forming a continuous coating when cast from a coating solution.

The polymer-containing carboxylic acid groups (i.e., Component A) conveniently is a copolymer of (1) at least one monomer selected from the group consisting of acrylic acid, methacrylic acid, and olefinic dicarboxylic acid (e.g., maleic or itaconic acid), and an olefinic dicarboxylic anhydride (e.g., maleic or itaconic anhydride), and (2) at least one monomer selected from the group consisting of an acrylate or methacrylate ester having 1 to 6 carbon atoms, a dialkylamine acrylate or methacrylate, styrene, vinyl acetate, vinyl methyl or ethyl ether, vinyl pyrrolidone, ethylene oxide, or the like. Some copolymers that may be selected as component A are methyl methacrylate (37%)/ethyl acrylate (56%)/acrylic acid (7%) terpolymer, acid no. 76–85, molecular weight 260,000; methyl methacrylate (61.75%)/ethyl acrylate (25.75%)/acrylic acid (12.5%) terpolymer, acid no. 100, molecular weight 200,000; styrene/maleic anhydride half ester copolymers, having styrene to maleic anhydride ratios of 1.4/1 to 1.0/1 and molecular weights from 60,000 to 215,000 and poly(methyl vinyl ether/maleic acid). An acrylic polymer containing alkylamino-ethylmethacrylate, such as a copolymer of butyl methacrylate/dimethylaminoethyl methacrylate, (80/20), average molecular weight 11,000 also may be selected to advantage.

Suitable polymers containing the cross-linkable group (i.e., Component B) include polyvinyl(alcohol), cellulose compounds such as polyhydroxyethyl cellulose and polyhydroxymethyl cellulose, melamine-formaldehyde resins, epoxy resins, polyamides, polyamines, polyisocyanates, polyacrylamides, polyvinyl pyrrolidone, and the like. Hydroxy containing polymers are preferred.

In one preferred embodiment, a single polymer is selected that contains the carboxylic acid group(s) and hydroxyl functionality. A volatile neutralizing component (e.g., ammonia, N,N-dimethyl ethanolamine, triethanol amine, or 2-amino-2-methyl propanol) provides 20 to 120%, preferably 40 to 100%, neutralization. The neutralizing component also adjusts pH of the coating solution above 4.0, which has been found to prevent cracking of the ink-receptive layer.

Reactive Componeny

The ink-receiving layer may contain a "Reactive Component" which, after printing, is activated by an external energy source to react both imaged and non-imaged areas of the printed media, and bind the ink to the media coating. In preferred embodiments, the ink polymeric dispersant is caused to react with a component of the ink-receiving layer. The same result may be achieved with disperse dye-based inks by selecting dyes that will react with the Reactive Component in the binder, upon exposure to an external energy source following the printing operation. The Reactive Component may have reactive acid groups, base groups, epoxy groups, styryl-pyridinium groups, styryl-pyrollium groups, dimethylmaleimide groups, cinnamic groups, unsaturated acrylic groups and bisazides which react with the ink-receiving layer components and/or the ink. Suitable Reactive Components are disclosed in U.S. Pat. No. 5,429,860 incorporated herein by reference.

Other Components

The ink-receiving layer also may contain an inorganic filler component to improve permeability of the aqueous carrier medium through the layer to the carrier medium absorbing layer below. Conventional inorganic fillers, such as silica, various silicates, zeolites, calcined kaolins, diatomaceous earths, barium sulfate, aluminum hydroxides, or calcium carbonate, are suitable for this purpose. The ratio of filler to other components will vary with the particular components and substrate, but generally be within the range of 7 to 1, to 0.5 to 1. Above 7 to 1, dusting tends to occur, and below 0.5 to 1, the coating tends to become too glossy. Other components may be present as well. For example, the composition may contain a surfactant, plasticizer, humectant, UV absorber, polymeric dispersant, defoamer, mold inhibitor, antioxidant, latex, dye mordant and optical brightener for conventional purposes.

Variations

For some applications, it may be desirable to combine the water-absorbing layer and ink-receiving layer as one layer. For example, if relatively low ink application rates will be used, or a relatively thick layer can be used to absorb the ink aqueous carrier medium, then the hydrophilic water-absorbing polymer and adhesive, ink-receiving polymer, and preferably a thermoplastic polymer, may be coated from a common coating solution to form a single layer that performs both functions.

The first substrate may be mounted on a backing layer, to improve transport properties of the media in the ink-jet printer, if the material selected as the first substrate does not possess the desired handling properties. The backing layer may have antistatic agents, matting agents, and the like that are commonly employed in the art. For example, the backing layer may have an abrasion resistant coating as disclosed in U.S. Pat. No. 5,069,942.

Preparation

The water-absorbing layer and the ink-receiving layer are sequentially applied to the media substrate, or the surface of the release layer thereon, at a dry coating weight of about 8 $g/M^2$ to 20 $g/M^2$ and about 1 $g/M^2$ to 5 $g/M^2$, respectively, for high coverage images. Appropriate coating weight is needed to provide sufficient ink vehicle absorbing capacity to prevent ink spread and/or puddling and to minimize cockle with porous substrates. The layers are applied to the first substrate by conventional coating methods such as roller coating or knife coating methods (e.g., air knife, trailing blade). All the ingredients can be premixed to form the compositions that are applied to the surface of the first substrate or the surface of the release layer at the dry coating weights set out above.

In a different embodiment the components of the water-absorbing layer and the ink-receiving layer are mixed and coated in a single layer on the first substrate in a dry coating weight range of about 2 $g/M_2$ to about 20 $g/M^2$.

Adhesion Balances

The adhesion balance between the various media layers is important if the media is to function as a transfer media. The adhesion force at the point of separation must be lower than the adhesion forces between all other layers remaining at separation. Release layers may be present between the layers at the point of separation to lower the adhesion force at the point of separation. Anchor layers may be present between layers, other than at the point of separation, to increase the adhesion force between layers. Any release or anchor layer that is present between the ink-receiving layer and water-absorbing layer must be permeable and not interrupt the flow of the carrier liquid to the water-absorbing layer. Preferably, these release layers are removed in use.

INK COMPOSITION

The ink has an aqueous carrier medium and an insoluble colorant, which may be a disperse dye or pigment dispersion. The colorant will react with the media's ink-receiving layer under prescribed conditions if the layer contains a Reactive Component. Preferably the colorant will be a pigment dispersion, in which case a polymeric material may serve both as the pigment dispersant and as a polymer that may be caused to react with the Reactive Component subsequent to printing. The ink also may contain other additives known in the art.

Aqueous Carrier Medium

The aqueous carrier medium is water or a mixture of water and at least one water-soluble organic solvent. Selection of a suitable mixture depends on requirements of the specific application, such as desired surface tension and viscosity, the selected colorant, ink drying time, and the type of substrate that will be printed. Representative examples of water-soluble organic solvents are disclosed in U.S. Pat. No. 5,085,698. A mixture of water and a polyhydric alcohol, such as diethylene glycol, is preferred as the aqueous carrier medium. If a mixture of water and a water-soluble solvent is used, the carrier typically will contain 30% to about 95% water with the balance (i.e., 70 to 5%) being the water-soluble solvent. Preferred compositions contain approximately 60% to 95% water, based on the total weight of the aqueous carrier medium.

The amount of aqueous carrier medium in the ink is in the range of approximately 40 to 99.8%, preferably 60 to 99.8%, based on total weight of the ink when an organic pigment is selected; approximately 25 to 99.8%, preferably 50 to 99.8% when an inorganic pigment is selected; and 80 to 99.8% when a disperse dye is selected.

Colorants

The carrier medium insoluble colorant may be a pigment, used in an insoluble particulate state, or a disperse dye. The pigment will be used with a polymeric dispersant, and the dye may be used with a polymeric additive, as discussed below. Either the dye, pigment, or pigment dispersant may contain groups that will react with a Reactive Component in the media ink-receiving layer under prescribed conditions, preferably by covalent bonding.

Pigments

Organic or inorganic pigments may be selected, alone or in combination. The pigment particles are sufficiently small to permit free flow of the ink through the ink jet printing device, especially at the ejecting nozzles that usually have a diameter ranging from 10 micron to 50 micron. The particle size also has an influence on the pigment dispersion stability, which is critical throughout the life of the ink. Brownian motion of minute particles will help prevent the particles from settling. It is also desirable to use small particles for maximum color strength. The range of useful particle size is approximately 0.005 micron to 15 micron. Preferably, the pigment particle size is 0.005 to 5 micron and most preferably, from 0.01 to 0.3 micron.

The selected pigment may be used in dry or wet form. For example, pigments are usually manufactured in aqueous media and the resulting pigment is obtained as water wet presscake. In presscake form, the pigment is not aggregated to the extent that it is in dry form. Thus, pigments in water wet presscake form do not require as much deaggregation in the process of preparing the inks from dry pigments. Representative commercial dry and presscake pigments that may be used to advantage are disclosed in U.S. Pat. No. 5,085,698.

Fine particles of metal or metal oxides also may be used to practice the invention. For example, metal and metal oxides are suitable for the preparation of magnetic ink jet inks. Fine particle size oxides, such as silica, alumina, titania, and the like, also may be selected. Furthermore, finely divided metal particles, such as copper, iron, steel, aluminum and alloys, may be selected for appropriate applications.

Organic pigments may be selected having groups that will react with a Reactive Component present in the ink-receiving layer of the media. Representative functional groups are acid, base, epoxy, and hydroxy groups.

When an organic pigment is selected, the ink may contain up to approximately 30% pigment by weight, but typically will be in the range of 0.1 to 15% (preferably 0.1 to 8%) by weight for most thermal ink jet printing applications. If an organic pigment is selected, the ink will tend to contain higher weight percentages of pigment than with comparable inks employing organic pigment, and may be as high as approximately 75% in some cases, because inorganic pigments generally have higher specific gravities than organic pigments.

Disperse Dyes

The color and amount of disperse dye used in the ink is largely a function of choice, being primarily dependent upon the desired color of the print achieved with the ink, the purity of the dye, and its strength. Low concentrations of dye may not give adequate color vividness. High concentrations may result in poor printhead performance or unacceptably dark colors. The disperse dye is present in the amount of 0.01 to 20%, by weight, preferably 0.05 to 8%, by weight, more preferably 1 to 5%, by weight, based on the total weight of the ink.

Optionally, dyes commonly used in aqueous inks which include, for example, Acid, Direct, Food and Reactive dyes, may be used in combination with the carrier medium insoluble colorant to improve chroma and hue. Preferably, these dyes are encapsulated in a carrier medium insoluble polymer.

Polymeric Dispersant

Pigments will be used in conjunction with a polymeric dispersant, which preferably will be an AB, BAB, or ABC block copolymer. The dispersant may have component groups capable of reacting with the media's ink-receiving layer component. For example, the dispersant may contain acid or amine groups that will serve this function. In addition, the dispersant may include a Reactive Component as discussed hereinafter. Random and graft polymeric dispersants are also known in the art, and may be selected in practicing the invention.

In AB or BAB block copolymers, the A segment is a hydrophobic homopolymer or copolymer which links to the pigment and the B block is a hydrophilic homopolymer or copolymer, or salt thereof, which disperses the pigment in the aqueous medium. Such polymeric dispersants are disclosed in Ma et al., U.S. Pat. No. 5,085,698. ABC triblocks are also useful as pigment dispersants. In the ABC triblock, the A block is a polymer compatible with water, the B block is a polymer capable of binding to the pigment and the C block is compatible with the organic solvent. The A and C blocks are end blocks. ABC triblocks and their synthesis are disclosed in Ma et al., European Patent Application 0 556 649 A1 published Aug. 28, 1993.

Although random copolymers can be used as dispersing agents, they are not as effective in stabilizing pigment dispersions as the block polymers, and therefore are not preferred. Useful random interpolymers have narrowly controlled molecular weight ranges preferably having poly dispersivities of 1–3, preferably 1–2. These polymers are substantially free of higher molecular weight species that readily plug pen nozzles. Number average molecular weight must be less than 10,000 Daltons, preferably less than 6,000, most preferably less than 3,000. As with the above-described block polymers, these random polymers contain hydrophobic and hydrophilic monomer units. Unfortunately, commercial random dispersant polymers tend to plug pen nozzles. However, needed molecular weight control can be obtained by using the Group Transfer Polymerization technique, or other methods that deliver low dispersivity. Some examples of hydrophobic monomers used in random polymers are methyl methacrylate, n-butyl methacrylate, 2-ethylhexyl methacrylate, benzyl methacrylate, 2-phenylethyl methacrylate and the corresponding acrylates. Examples of hydrophilic monomers are methacrylic acid, acrylic acid, dimethylaminoethyl [meth]acrylate and salts thereof. Also quaternary salts of dimethylaminoethyl [meth]acrylate may be employed.

When a disperse dye is selected, a polymer may be added to the ink for a variety of reasons. The polymer additive may have component groups that react with the media's ink-receiving layer component, or may include a Reactive Component.

Other Ingredients

Consistent with the particular application, various types of additives may be used to modify the ink properties. Anionic, nonionic, or amphoteric surfactants may be used in addition to the polymeric dispersants. A detailed list of non-polymeric as well as some polymeric surfactants are listed at pages 110–129, of 1990 McCutcheon's Functional Materials, North American Edition, Manufacturing Confection Publishing Co., Glen Rock, N.J. The choice of a specific surfactant is highly dependent on the particular ink composition and type of media substrate to be printed. One skilled in the art can select the appropriate surfactant for the specific substrate to be used in the particular ink composition. In aqueous inks, the surfactants may be present in the amount of 0.01 to 5%, preferably 0.2 to 2%, based on the total weight of the ink.

Cosolvents may be included to improve penetration and pluggage inhibition properties of the ink composition, and are preferred. Such cosolvents are well known in the art and are exemplified in U.S. Pat. No. 5,272,201. Biocides may be used to inhibit growth of microorganisms. Dowicides® (Dow Chemical, Midland, Mich.), Nuosept® (Huls America, Inc., Piscataway, N.J.), Omidines® (Olin Corp., Cheshire, Conn.), Nopcocides® (Henkel Corp., Ambler, Pa.), Troysans® (Troy Chemical Corp., Newark, N.J.) and sodium benzoate are examples of such biocides. Sequestering agents such as EDTA may also be included to eliminate deleterious effects of heavy metal impurities. Other known additives, such as humectants, viscosity modifiers and other acrylic or non-acrylic polymers may also be added to improve various ink properties.

Ink Properties

Jet velocity, separation length of the droplets, drop size and stream stability are greatly affected by the surface tension and the viscosity of the ink. Pigmented ink jet inks suitable for use with ink jet printing systems should have a surface tension of about 20 dyne/cm to about 70 dyne/cm and, more preferably, in the range 30 dyne/cm to about 70 dyne/cm at 20° C. Acceptable viscosities are no greater than 20 cP, and preferably in the range of about 1.0 cP to about 10.0 cP at 20° C. The ink has physical properties compatible with a wide range of ejecting conditions, i.e., driving voltage and pulse width for thermal ink jet printing devices, driving frequency of the piezo element for either a drop-on-demand device or a continuous device, and the shape and size of the nozzle. The inks have excellent storage stability for long periods and do not clog an ink jet apparatus. Fixing of the ink on the media or image recording material (such as, paper, fabric, film) can be carried out speedily and surely. The printed ink images have clear color tones, high density, excellent water resistance and light fastness. Further, the ink does not corrode parts of the ink jet printing device, and is essentially odorless and non-toxic.

SECOND SUBSTRATE

The second substrate may be a permanent support or a transfer element.

Permanent Support

The permanent support for the colored image can be chosen from almost any sheet material desired. If the image is to be used without transfer, the media substrate will be the permanent support. For most applications a paper permanent support is used. Other materials which can be used as the permanent support include cloth, wood, glass, china, polymeric films, synthetic papers, thin metal sheets or foils, cardboard, etc. An adhesive may be employed to achieve desired bonding strength between the ink-receiving layer and the permanent support.

Transfer Element

It is noted that, in embodiments discussed above, the printed image is reversed as the ink-receiving layer is adhered to a permanent substrate. Thus, the ink-jet printer is caused to print a reverse image. In another embodiment, a transfer element may be employed to serve as a temporary receptor that receives the colored image formed on the media ink-receiving layer. While the ink-receiving layer is temporarily bonded to the transfer element, either (i) the media substrate is adhered to a permanent support, or (ii) the water-absorbing layer and/or media substrate are removed from the ink-receiving layer, and the surface so exposed is adhered to a permanent substrate. In either case, the transfer element then typically is removed to expose the printed image, although the transfer element may remain as a protective covering if it is transparent. Thus, the image is reversed a second time through use of a temporary support, and the image appears as observed after printing.

The transfer element has, in order, an optional temporary coversheet, a transfer release layer, and a transfer support. However, no release layer is necessary if the transfer support is constructed of a material (e.g., polyethylene or a fluoropolymer) having a release surface.

The transfer support is constructed of a material having sufficient stiffness and dimensional stability that the printed image is supported without shifting or misalignment. The support is generally smooth and flat. Examples of suitable materials include polymeric films such as polyesters, including polyethylene terephthalate and polyethylene naphthanate; polyamides; polycarbonates; fluoropolymers; polyacetals; and polyolefins. Alternatively, the transfer support can be a thin metal sheet or a paper substrate or synthetic paper. Polyethylene terephthalate film is a preferred transfer support. The transfer support typically has a thickness of about 20 to about 250 micrometers (1.0 to 10 mils). A preferred thickness is about 75 to 200 micrometers (3 to 8 mils).

The transfer release layer, if present, should have sufficient adhesion to the transfer support to remain affixed throughout all the process steps. At the same time, the adhesiveness of the transfer release layer is carefully balanced with the adhesiveness of the release layer on the media substrate in order to carry out the transfer steps in the process of the invention. The relative adhesion balances will be discussed in greater detail below.

Release layers described above for the media substrate may be used on the transfer element as well, provided that the adhesion balance is met. Representative materials include silicones, vinyl chloride polymers and copolymers, vinyl acetate polymers and copolymers, and plasticized polyvinyl alcohol. The release material may either constitute the transfer element, or be present as a coating, typically 1 to 10 micrometers thick.

The transfer element also may have a "cushion layer"; i.e., a deformable layer having a thickness in the range of about 25 to 150 micrometers (1 to 6 mils), preferably 75 to 125 micrometers (3 to 5 mils), between its substrate and the release layer. The deformable cushion layer assures that the media film stays in close contact with the transfer element at all points across the nip during lamination. This provides optimum lamination quality. Without the cushion layer, dirt particles between the media and transfer element can keep the film separated and cause spot lamination defects.

Representative materials that can be selected to form the cushion layer include ethylene/vinyl acetate copolymers; ethylene/methacrylic acid copolymers and ionomers; ethylene/acrylic acid copolymers and ionomers; ethylene/methacrylate copolymers; ethylene/methacrylic acid/isobutylacrylic acid ionomers; and mixtures thereof. Ethylene/vinyl acetate copolymers are preferred. Materials such as surfactants, plasticizers, coating aids and the like may be incorporated for conventional purposes. It may be necessary to employ an anchor layer, typically 0.1 to 10 micrometers thick (preferably 0.5 to 2 micrometers) to ensure adequate adhesion of the cushion layer to the Transfer Element substrate.

The Transfer Element may have an easily removable coversheet to protect the underlying layers prior to use.

Preferred coversheets are self-releasing films, such as polyethylene or polyethylene terephthalate. These films can be coated with a release layer, such as silicone, provided the release layer is removed cleanly with the film. The thickness of the temporary coversheet typically is in the range of 25 to 250 micrometers (1 to 10 mils).

APPLICATIONS

The media provided by this invention may receive ink printed by conventional ink-jet printers, such as thermal or bubble jet printers, piezoelectric printers, continuous flow printers, or valve jet printers. After the ink is printed on the media, the printed media is air dried. This printed media may be used as is, in which case the media substrate functions as the permanent support and no release layer is present between the media substrate and the water-absorbing layer. If the media ink-receiving layer contains a thermoplastic polymer, the layer then is heated to soften the polymer, causing it to at least partially encapsulate the ink pigment and then cross-link.

In another embodiment, the ink-receiving layer contains a Reactive Component activated by (i) heat, in which case a heated roll or platen conveniently may be employed, or (ii) radiation, such as UV light. In either case, uniform treatment renders printed and non-printed areas of the media more durable, water-fast and smear-resistant, as well as improving the binding of the ink colorant to the ink-receiving layer.

Transfer Processes

A transfer process may be used to produce a single or multi-colored image on a permanent substrate. For example, a media may be printed with one or more colored inks, and then transferred to a permanent substrate, which may have been primed or have an adhesive layer to ensure durable bonding. Then, the media substrate and water-absorbing layer are readily removed by stripping, leaving the ink-receiving layer on the permanent substrate. Stripping may be facilitated by the presence of a release layer; or release components may be contained in the ink receiving layer and/or preferably in the water absorbing layer. In a variation, this process may be repeated with the ink-receiving layer containing various colors of ink dispersions to build up a multi-colored image. In these applications, it is important that the ink-receiving layer have the desired degree of transparency because the colorant is viewed through the layer. The ink-receiving layer may be cross-linked, and/or Reactive Components in the color dispersion activated, during lamination to the permanent substrate or by a post-treatment, depending on the selected components.

Alternatively, the ink-receiving surface may be laminated to a Transfer Element, with the media substrate and water-absorbing layers then being stripped off. If desired, this process may be repeated seriatim with different colored images in registry, or all desired colors may be printed on a single media. The exposed ink-receiving layer then is laminated to the desired permanent substrate, which may be primed or have an adhesive layer to achieve the desired bonding strength, and the Transfer Element is removed by stripping. The resulting image is "right-reading"; i.e., is viewed as printed, with the printed image on the surface. Treatment of the ink-receiving layer to cross-link thermoplastic resin and/or Reactive Components that are present in some embodiments may occur prior to, during, or after the lamination step to the permanent substrate.

INDUSTRIAL UTILITY

The media and processes of the invention have commercial utility for utilizing ink-jet printing technologies, with aqueous ink dispersions, to provide high quality printed images on a broad variety of substrates. Pictoral as well as textured information may be printed. For multicolored images, yellow, cyan, magenta and black inks may be used to advantage. Applications include desktop publishing, as well as wide format applications such as the printing of signs, banners, and the like.

The invention will now be further illustrated, but not limited, by the examples.

EXAMPLES

The inks used in the examples had the following compositions and were prepared using a procedure similar to that described in Example 1 of U.S. Pat. No. 5,310,778 issued May 10, 1994:

Cyan Ink:

| INGREDIENT | AMOUNT (%) |
|---|---|
| Monolite ® GT 751D, Zeneca, Wilmington, DE | 0.81 |
| Endurophthal Blue BT-617D, Cookson Pigments, Inc., Newark, NJ. | 2.19 |
| Butyl methacrylate/methyl methacrylate// methacrylic acid, (BMA/MMA//MAA) (10/5//10)[1] | 2.00 |
| Diethylene glycol | 4.50 |
| Liponics ® EG-1, Lipo Chemical Co., Paterson, NJ. | 5.00 |
| Multranol ® 4012, Miles, Inc., Pittsburg, PA. | 2.50 |
| Dantocol ® DHE, Lonza Inc., Fairlawn, NJ | 1.00 |
| Deionized water | 82.00 |
| The ink had a pigment to dispersant ratio of 1.5:1. | |

Magenta Ink:

| INGREDIENT | AMOUNT (%) |
|---|---|
| Quindo ® Magenta RV6803, Miles, Inc., Pittsburg, PA. | 3.045 |
| Indofast ® Brilliant Scarlet R6300, (Pigment Red 163, C.I. No. 71145), Miles, Inc., Pittsburg, PA. | 0.455 |
| Butyl methacrylate/methyl methacrylate// methacrylic acid, (BMA/MMA//MAA) (10/5//10)[1] | 2.33 |
| Tetra-ethylene glycol | 8.70 |
| 2-pyrrolidone | 5.25 |
| Multranol ® 4012, Miles, Inc., Pittsburg, PA. | 2.50 |
| Dantocol ® DHE, Lonza Inc., Fairlawn, NJ | 0.50 |
| Deionized water | 77.22 |
| The ink had a pigment to dispersant ratio of 1.5:1. | |

Yellow Ink:

| INGREDIENT | AMOUNT (%) |
|---|---|
| Cromophthal ® 8GN pigment, Ciba Geigy, Scarsdale, NY. | 5.00 |
| Butyl methacrylate/methyl methacrylate// methacrylic acid, (BMA/MMA//MAA) (10/5//10)[1] | 5.00 |
| Tetra-ethylene glycol | 4.00 |
| Liponics ® EG-1, Lipo Chemical Co., Paterson, N.J. | 5.00 |
| 2-pyrrolidone | 6.00 |
| Deionized water | 72.50 |
| The ink had a pigment to dispersant ratio of 1:1. | |

[1]Polymer 3 in U.S. Pat. No. 5,310,778. Made as described therein.

Black Ink:

| INGREDIENT | AMOUNT (%) |
|---|---|
| Raven Black pigment, Columbian Chemical Co., Jamesburg, NJ. | 3.60 |
| Butyl methacrylate/methyl methacrylate// methacrylic acid, (BMA/MMA//MAA) (10/5//10)[1] | 2.00 |
| Diethylene glycol | 5.70 |
| Liponics ® EG-1, Lipo Chemical Co., Paterson, N.J. | 5.70 |
| N-methylpyrrolidone | 0.90 |
| Nuosept ® 95, Huls America Inc., Piscataway, NJ. | 0.49 |
| Proxel ® GXL | 0.24 |
| Deionized water | 81.67 |
| The ink had a pigment to dispersant ratio of 1.8:1. | |

Example 1

This example illustrates a two layer ink jet media that can be laminated to a variety of substrates after printing. It consists of a polyethylene terephthalate support film coated with a water absorbing layer, which is overcoated with a water permeable adhesive layer. The adhesive is non-tacky at room temperature, but adheres well to various substrates when laminated at elevated temperatures.

The coating solution for the water absorbing layer was prepared by first dissolving 8.7 grams of polyvinyl pyrrolidone (ISP Co. grade K-90, molecular weight 1,280,000) in 88.4 grams of water. To this was added 15.4 grams of a 5% aqueous solution of methylhydroxy-propyl cellulose (Culminal® MHPC-25, approximately 15,000 molecular weight, sold by Aqualon Co.). 32.4 grams of a 9% aqueous solution of acrylic resin (Goodrich Co. Carboset® 526, acid number 100, molecular weight 200,000), neutralized with 0.4 grams of 28% ammonium hydroxide to make it soluble, were also added. This solution was coated on 100 micron thick corona treated polyethylene terephthalate film, using a 254 micron doctor blade coating knife, to give a dry coating weight of about 140 mg/dm$^2$.

The coating solution for the water permeable adhesive layer was made by mixing 24.0 grams of Vylonal® MD-1400 with 26.8 grams of Vylonal® MD-1100 (both are polyester adhesive dispersions having 14.5% and 30% solids respectively, sold by Toyobo Co.), and adding 67.0 grams of water, 22.4 grams of 2-butoxy-ethanol, 44.8 grams of 2-propanol, and 15.0 grams of N-methylpyrrolidone to the mixture. This solution was coated over the water absorbing film prepared above, using a #5 Meyer rod coating applicator. Dry coating weight of the water permeable adhesive layer was about 15 mg/dm$^2$.

Images were printed on the media using a Hewlett-Packard 550-C ink jet printer filled with the yellow, magenta, cyan, and black inks described above. Both dye and pigment based inks were used. After printing, the media adhesive surface was laminated to a variety of permanent substrate materials, using a hot roll laminator operated at 200 mm/min, with a roll temperature of 120° C., and a load of 15 lbs/in. After lamination, the corona treated polyethylene terephthalate support film was peeled off, leaving the image, and both media coatings on the substrate. Permanent substrates that were successfully laminated included 50 micron thick copper foil, polyethylene terephthalate, vinyl, and polyethylene plastic films, coated and non-coated printing papers such as Vintage Gloss® paper (Potlatch Co., Cloquet, Minn.), Reflections® paper, (Consolidated Paper Co., Wisconsin Rapids, Wis.), Warrenflo® paper (S. D. Warren Co., Boston, Mass.) and Textweb® paper (Champion Paper Co., Stamford, Conn.), and corrugated cardboard.

Example 2

The two layer ink jet media described in Example 1 was coated on gelatin subbed polyethylene terephthalate film, instead of on corona treated polyethylene terephthalate film. The coatings adhered very strongly to the gelatin subbed polyethylene terephthalate film. As a result, after printing the media and laminating it to the desired substrate, the gelatin subbed polyethylene terephthalate film remained bonded to the media coatings. This provided extra protection for the coatings and image.

Example 3

This example illustrates that the adhesive and the water absorbing components can be combined in a single layer.

The coating solution was made by mixing 29.8 grams of Vylonal® MD-1400 polyester dispersion with 13.0 grams of water and 7.2 grams of a 15% aqueous solution of polyvinyl pyrrolidone (ISP grade K-90) and 0.03 grams of Zonyl® FSO-100 surfactant (DuPont Co.). This solution was coated with a #50 Meyer rod coating applicator, to give a 150 mg/dm$^2$ dry coating weight. The base on which it was coated was 50 micron thick corona treated polyethylene terephthalate film, that had been coated with a 2 micron thick layer of Adcote® 56220, to give it release properties. Adcote® 56220 is an aqueous dispersion of ionomer resin sold by Morton International. Images were printed on the media with an ink jet printer, as described in Example 1. After printing, the media was laminated to paper, as described in Example 1. Then the polyethylene terephthalate support film with its release layer was peeled off, leaving the image and the ink jet coating on the paper.

Example 4

This example illustrates an ink jet media that can be printed, then transferred to other substrates, and finally heated to make the image more durable.

The media consists of a polyethylene terephthalate support film coated with a water absorbing layer, which is overcoated with a water permeable adhesive layer. The adhesive is non-tacky at room temperature, but adheres well to various substrates when laminated at elevated temperatures.

The coating solution for the water absorbing layer was prepared by first dissolving 6.2 grams of polyvinyl alcohol (Elvanol® 52-22, DuPont, Wilmington, Del.) in 62.2 grams of water. To this was added 45.6 grams of a 9% aqueous solution of acrylic resin (Carboset® 526, acid number 100, molecular weight 200,000, Goodrich Co., Brecksville, Ohio), which was neutralized with 0.5 grams of 28% ammonium hydroxide to make it soluble. This solution was coated on 50 micron thick corona treated polyethylene terephthalate film, at a dry coating weight of 136 mg/dm$^2$.

The coating solution for the water permeable adhesive layer was made by mixing 24.0 grams of Vylonal® MD-1400 with 26.8 grams of Vylonal® MD-1100 (both are polyester adhesive dispersions having 14.5% and 30% solids respectively, sold by Toyobo Co.), and adding 67.0 grams of water, 22.4 grams of 2-butoxy-ethanol, 44.8 grams of 2-propanol, and 15.0 grams of N-methylpyrrolidone. This solution was coated over the water absorbing film prepared above, using a #5 Meyer rod coating applicator. Dry coating weight of the water permeable adhesive layer was about 15 mg/dm$^2$.

Images were printed on the media using a Hewlett-Packard 550-C ink jet printer filled with yellow, magenta, cyan, and black pigment based inks. After printing, the media adhesive surface was laminated to plain printing paper using a hot roll laminator operated at 200 mm/min, with a roll temperature of 120° C., and a load of 15 lbs/in. After lamination, the corona treated polyethylene terephthalate support film was peeled off, leaving the image, and both media coatings on the paper.

The image was tested for durability by rubbing with a cotton-tipped stick soaked in water. The sample was then placed in 140° C. oven for 5 minutes to durabilize the image. After baking, the sample was retested for image durability. Results were:

| | Rubs to Smear Image |
|---|---|
| Before Heating | 45 |
| After Heating | 82 |

The results show that heating the image made it more durable.

Example 5

This example illustrates a three layer ink jet media that can be printed and then laminated to a substrate such as paper. After lamination, the media's polyethylene terephthalate support film is peeled off, taking with it all media layers except the one carrying the ink image, which stays on the paper substrate. The media consists of a polyethylene terephthalate support film coated with a water absorbing layer, which is overcoated with a release layer. On top of the release layer is coated a water permeable adhesive layer, that is non-tacky at room temperature.

The coating solution for the water absorbing layer was prepared by first dissolving 8.7 grams of polyvinyl pyrrolidone (ISP Co. grade K-90, molecular weight 1,280,000) in 88.4 grams of water. To this was added 15.4 grams of a 5% aqueous solution of methylhydroxy-propyl cellulose (Culminal® MHPC-25, approximately 15,000 molecular weight, sold by Aqualon Co., Wilmington, Del.). Also added was 32.4 grams of a 9% aqueous solution of acrylic resin (Goodrich Co. Carboset® 526, acid number 100, molecular weight 200,000), which was neutralized with 0.4 grams of 28% ammonium hydroxide to make it soluble. This solution was coated on 100 micron thick gel subbed polyethylene terephthalate film, at a dry coating weight of 200 mg/dm$^2$.

Coated over this was a release layer. The coating solution consisted of 2 grams of water mixed with 10 grams of Adcote® 56220, an aqueous dispersion of ionomer resin sold by Morton International. This layer was coated with a #10 Meyer rod at a dry coating weight of 20 mg/dm$^2$.

A water permeable adhesive layer was coated on top of the release layer. The adhesive coating solution was made by mixing 24.0 grams of Vylonal® MD-1400 with 26.8 grams of Vylonal® MD-1100 (both are polyester adhesive dispersions having 14.5% and 30% solids respectively, sold by Toyobo Co.), and adding 67.0 grams of water, 22.4 grams of 2-butoxyethanol, 44.8 grams of 2-propanol, and 15.0 grams of N-methyl-pyrrolidone to the mixture. It was coated with a #5 Meyer rod to give a dry coating weight of about 15 mg/dm$^2$.

Images were printed on the media using a Hewlett-Packard 550-C ink jet printer filled with yellow, magenta, cyan, and black pigmented inks. After printing, the media adhesive surface was laminated to ordinary printing paper using a hot roll laminator operated at 200 mm/min, with a roll temperature of 120° C., and a load of 15 lbs/in. After lamination, the polyethylene terephthalate support film was peeled off, taking with it the water absorbing layer and the release layer. The ink image and the adhesive layer remained on the paper.

Example 6

For this example a temporary transfer sheet was used with the media described in Example 5 to generate an image. First, an ink image was printed on the media, described in Example 5. Then, the media's adhesive surface was laminated to a transfer sheet. The transfer sheet consisted of a 100 micron thick polyethylene terephthalate support film on which had been extruded a 25 micron thick layer of Nucrel® 0910 resin (polyethylene/methacrylic acid copolymer, melt flow index=10 dg/min, sold by DuPont). Lamination conditions were 400 mm/min, 120° C. roll temperature, 5 lbs/inch load. The media's polyethylene terephthalate support film was then peeled off, taking with it the media's water absorbing layer and release layer. This left the ink image and the media's adhesive layer on the Nucrel® surface of the transfer sheet. Next, ordinary printing paper was laminated to the adhesive layer of the transferred element. Lamination conditions were 400 mm/min, 120° C. roll temperature, 15 lbs/inch load. Finally, the transfer sheet's polyethylene terephthalate film was peeled off, leaving a right-reading image consisting of the media's adhesive plus ink image and the transfer sheet's Nucrel® layer on the paper. The Nucrel® layer protected the image from smearing or scuffing.

What is claimed is:

1. A medium adapted to receive an ink image from an ink-jet printer, for subsequent transfer to a permanent substrate, said medium comprising, in order:

(a) a substrate (b) a water-absorbing layer located closest to the substrate comprising a hydrophilic polymer that is substantially solid in the presence of an aqueous ink; and (c) a transparent, adhesive, ink-receiving layer located furthest from the substrate that is permeable to an aqueous carrier of the ink and holds the image formed by a colorant contained in the ink; wherein the ink-receiving layer is releasable from the medium to facilitate transfer of the ink-receiving layer to a permanent substrate subsequent to image formation.

2. The medium of claim 1 wherein said hydrophilic polymer is selected from the group consisting of a polyvinyl alcohol homopolymer, a polyvinyl alcohol copolymer, a polyvinyl pyrrolidone homopolymer, a polyvinyl pyrrolidone copolymer, a super absorbent acrylic polymer and a super absorbent methacrylic polymer.

3. The medium of claim 2 wherein said hydrophilic polymer is selected from the group a consisting of polyvinyl alcohol homopolymer or copolymer and a partially hydrolyzed poly(vinyl alcohol).

4. The media of claim 1 or 2 wherein said water-absorbing layer also contains property modifier selected from the group consisting of acrylic resin, mixed cellulose ester, and styrene/maleic acid copolymer.

5. The medium of claim 1 wherein said ink-receiving layer is selected from the group consisting of a polyester resin and a vinyl acetate copolymer.

6. The medium of claim 1 wherein said ink-receiving layer also contains a thermoplastic polymer having a reactive moiety that will cross-link at elevated temperature.

7. The medium of claim 6 wherein said thermoplastic polymer has at least one carboxylic group and at least one hydroxyl, epoxy, amine, isocyanate, amide, or acrylamide group.

8. The medium of claim 6 wherein said thermoplastic polymer is a blend of a polymer A having at least one carboxylic acid group, and a polymer B having at least one hydroxyl, epoxy, amine, isocyanate, amide, or acrylamide group.

9. The medium of claim 8 wherein polymer A is a copolymer of at least one monomer selected from the group consisting of acrylic acid, methacrylic acid, and an olefinic dicarboxylic acid, and at least one monomer selected from the group consisting of an acrylate or methacrylate ester having 1 to 6 carbon atoms, a dialkylamine acrylate or methacrylate, styrene, vinyl acetate, vinyl methyl or ethyl ether, vinyl pyrrolidone, and ethylene oxide.

10. The medium of claim 8 wherein polymer B is a polymer containing hydroxyl groups.

11. The medium of claim 8 wherein polymer B is selected from the group consisting of polyvinyl alcohol, cellulose compounds, melamine-formaldehyde resins, epoxy resins, polyamides, polyamines, polyisocyanates, polyacrylamides and polyvinyl pyrrolidone.

12. The medium of claim 6 wherein said thermoplastic polymer is a polymer containing at least one carboxylic acid group and hydroxyl functionality.

13. The medium of claim 1, wherein said ink-receiving layer also contains a component which, when activated by an external energy source, will react with both imaged and non-imaged areas of the printed media and bind the ink to the layer.

14. The medium of claim 1 wherein said ink-receiving layer also contains an inorganic filler.

15. The medium of claim 1 having a release layer between said ink-receiving and water-absorbing layers.

16. The medium of claim 1 wherein said ink receiving layer bears a pigment and a polymeric dispersant.

17. The medium of claim 1 wherein a backing layer is present on the substrate on the side opposite the water absorbing layer.

18. The medium of claim 1 wherein said ink-receiving layer also contains a component having at least one reactive group selected from acid groups, base groups, epoxy groups, styryl-pyridinium groups, styryl-pyrollium groups, dimethylmalimide groups, cinnnamic groups, unsaturated acrylic groups and bisazides.

* * * * *